US010355436B2

(12) United States Patent
Van Swearingen

(10) Patent No.: US 10,355,436 B2
(45) Date of Patent: Jul. 16, 2019

(54) METHOD AND APPARATUS FOR RADIAL ULTRASONIC WELDING INTERCONNECTED COAXIAL CONNECTOR

(71) Applicant: CommScope Technologies LLC, Hickory, NC (US)

(72) Inventor: Kendrick Van Swearingen, Woodridge, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/670,581

(22) Filed: Aug. 7, 2017

(65) Prior Publication Data

US 2017/0338613 A1 Nov. 23, 2017

Related U.S. Application Data

(63) Continuation of application No. 13/170,958, filed on Jun. 28, 2011, now Pat. No. 9,728,926, which is a (Continued)

(51) Int. Cl.

| | |
|---|---|
| ***H01R 9/05*** | (2006.01) |
| ***H01R 43/02*** | (2006.01) |
| ***H01R 13/504*** | (2006.01) |

(52) U.S. Cl.

CPC ..... *H01R 43/0207* (2013.01); *H01R 9/05* (2013.01); *H01R 13/504* (2013.01); *Y10T 29/49123* (2015.01); *Y10T 29/49204* (2015.01)

(58) Field of Classification Search

CPC .... H01R 43/0207; H01R 9/05; H01R 13/504; Y10T 29/49123; Y10T 29/49204

(Continued)

(56) References Cited

U.S. PATENT DOCUMENTS 3,089,105 A 5/1963 Alford
3,142,716 A * 7/1964 Gardener ..... B29C 45/14073 249/95

(Continued)

FOREIGN PATENT DOCUMENTS

CN 1606200 4/2005
CN 1623254 6/2005

(Continued)

OTHER PUBLICATIONS

European Examination Report Corresponding to Patent Application No. 11 843 870.4; dated Mar. 10, 2017; 5 Pages.

(Continued)

*Primary Examiner* — Abdullah A Riyami
*Assistant Examiner* — Vladimir Imas
(74) *Attorney, Agent, or Firm* — Myers Bigel, P.A.

(57) ABSTRACT

A coaxial connector assembly for interconnection with a coaxial cable with a solid outer conductor is provided with a monolithic connector body with a bore. A mating surface with a decreasing diameter toward a connector end is provided on an outer diameter of the connector body proximate the connector end. An overbody may be provided overmolded upon a cable end of the connector body. An interface end may be seated upon the mating surface, the interface end provided with a desired connection interface. The interface end may be permanently coupled to the mating surface by a molecular bond interconnection. In a method of interconnection, the interface end is coupled to the mating surface by application of radial ultrasonic welding.

21 Claims, 8 Drawing Sheets

Related U.S. Application Data continuation-in-part of application No. 13/161,326, filed on Jun. 15, 2011, now Pat. No. 8,365,404, which is a continuation-in-part of application No. 12/980,013, filed on Dec. 28, 2010, now Pat. No. 8,453,320, application No. 13/170,958, which is a continuation-in-part of application No. 12/974,765, filed on Dec. 21, 2010, now Pat. No. 8,563,861, which is a continuation-in-part of application No. 12/951,558, filed on Nov. 22, 2010, now Pat. No. 8,826,525, application No. 12/980,013, which is a continuation-in-part of application No. 12/951,558, filed on Nov. 22, 2010, now Pat. No. 8,826,525.

(58) Field of Classification Search
USPC ..... 439/578
See application file for complete search history.

(56) References Cited

U.S. PATENT DOCUMENTS 3,219,657 A 11/1965 Quintana
3,264,602 A 8/1966 Schwartz
3,295,095 A 12/1966 Kraus
3,384,703 A 5/1968 Forney et al.
3,453,376 A * 7/1969 Armand ..... H01R 4/56 174/75 C
3,644,878 A * 2/1972 Toedtman ..... H01R 11/09 174/72 R
3,656,092 A 4/1972 Swngel et al.
3,665,367 A 5/1972 Keller et al.
3,720,805 A * 3/1973 Fitzgerald ..... B21K 1/62 219/152
3,949,466 A 4/1976 O'Brien et al.
3,980,976 A 9/1976 Tadama et al.
4,039,244 A 8/1977 Leachy
4,176,909 A 12/1979 Prunier
4,241,973 A 12/1980 Mayer et al.
4,397,515 A 8/1983 Russell
4,521,642 A 6/1985 Vives
4,746,305 A 5/1988 Nomura
4,790,375 A * 12/1988 Bridges ..... E21B 36/006 166/304
4,824,400 A 4/1989 Spinner
4,867,370 A 9/1989 Welter et al.
4,891,015 A 1/1990 Oldfield
4,943,245 A 7/1990 Lincoln
5,046,952 A 9/1991 Cohen et al.
5,076,657 A 12/1991 Toya et al.
5,120,237 A * 6/1992 Fussell ..... H01R 13/5202 439/282
5,120,268 A * 6/1992 Gerrans ..... H01R 13/523 439/736
5,154,636 A * 10/1992 Vaccaro ..... H01R 24/564 439/578
5,186,644 A 2/1993 Pawlicki et al.
5,203,079 A 4/1993 Brinkman et al.
5,284,449 A 2/1994 Vaccaro
5,299,939 A 4/1994 Walker et al.
5,354,217 A * 10/1994 Gabel ..... H01R 24/564 439/583
5,464,963 A 11/1995 Hostler et al.
5,474,470 A 12/1995 Hammond, Jr.
5,542,861 A 8/1996 Anhalt et al.
5,561,900 A 8/1996 Hosler, Sr.
5,700,989 A 12/1997 Dykhno et al.
5,733,145 A * 3/1998 Wood ..... H01R 13/562 439/589
5,789,725 A 8/1998 McIntire et al.
5,791,919 A * 8/1998 Brisson ..... H01R 27/00 439/166
5,796,315 A 8/1998 Gordon et al.
5,802,710 A 9/1998 Bufanda et al.
5,802,711 A 9/1998 Card et al.
5,823,824 A * 10/1998 Mitamura ..... H01R 13/50 439/585
5,929,728 A * 7/1999 Barnett ..... H01P 3/121 29/600
5,938,474 A 8/1999 Nelson
6,007,378 A * 12/1999 Oeth ..... H01R 13/5213 439/279
6,032,835 A 3/2000 Burt
6,093,043 A 7/2000 Gray
6,139,354 A * 10/2000 Broussard ..... H01R 13/523 439/447
6,148,237 A * 11/2000 Das ..... A61N 1/056 607/122
6,155,212 A * 12/2000 McAlister ..... F02B 43/08 123/25 B
6,173,097 B1 1/2001 Throckmorton et al.
6,174,200 B1 1/2001 Bigotto et al.
6,176,716 B1 1/2001 Mercurio et al.
6,287,301 B1 * 9/2001 Thompson ..... A61B 18/1492 604/524
6,361,364 B1 3/2002 Holland et al.
6,362,428 B1 * 3/2002 Pennington ..... E21B 17/028 16/2.2
6,394,187 B1 * 5/2002 Dickson ..... E21B 34/063 166/332.8
6,407,722 B1 6/2002 Bogner et al.
6,439,924 B1 8/2002 Kooiman
6,471,545 B1 8/2002 Hosler, Sr.
6,482,036 B1 * 11/2002 Broussard ..... H01R 13/523 439/606
6,588,646 B2 * 7/2003 Loprire ..... B23K 20/10 228/110.1
6,607,399 B2 8/2003 Endo et al.
6,752,668 B2 6/2004 Koch, Jr.
6,776,620 B2 8/2004 Noda
6,786,767 B1 * 9/2004 Fuks ..... H01R 9/05 439/578
6,793,095 B1 9/2004 Dulisse et al.
6,814,625 B2 11/2004 Richmond et al.
6,837,751 B2 * 1/2005 Vanden Wymelenberg ..... H01R 43/28 439/347
6,932,644 B1 8/2005 Taylor
7,044,785 B2 5/2006 Harwath et al.
7,061,829 B2 * 6/2006 Scott ..... G01V 1/201 367/154
7,134,190 B2 * 11/2006 Bungo ..... B23K 20/10 29/753
7,144,274 B2 12/2006 Taylor
7,198,208 B2 * 4/2007 Dye ..... F02M 27/04 123/536
7,217,154 B2 5/2007 Harwath
7,347,738 B2 3/2008 Hsieh et al.
7,399,069 B2 * 7/2008 Therien ..... B41J 2/17523 347/49
7,476,114 B1 1/2009 Contreras
7,620,770 B2 4/2009 Arnaud et al.
7,607,942 B1 8/2009 Van Swearingen
7,677,812 B2 3/2010 Castagna
7,705,238 B2 4/2010 Van Swearingen
7,731,529 B1 5/2010 Islam
7,753,727 B1 7/2010 Islam et al.
7,798,848 B2 9/2010 Islam
7,819,302 B2 10/2010 Bolser et al.
8,174,132 B2 5/2012 Van Swearingen
8,453,320 B2 6/2013 Van Swearingen et al.
8,622,762 B2 * 1/2014 Van Swearingen .... H01R 24/38 439/248
8,801,460 B2 * 8/2014 Van Swearingen ..... H01Q 1/00 439/578
8,887,379 B2 11/2014 Van Swearingen et al.
9,889,586 B2 2/2018 Van Swearingen et al.
2004/0082212 A1 4/2004 Cannon
2004/0196115 A1 10/2004 Fallon et al.
2005/0181652 A1 8/2005 Montena et al.
2005/0285702 A1 12/2005 Graczyk et al.
2006/0137893 A1 6/2006 Sumi et al.

(56) References Cited

U.S. PATENT DOCUMENTS

| | | | |
|---|---|---|---|
| 2007/0042642 | A1 | 2/2007 | Montena et al. |
| 2007/0224880 | A1 | 9/2007 | Wlos et al. |
| 2007/0259565 | A1 | 11/2007 | Holland |
| 2009/0151975 | A1 | 6/2009 | Moe et al. |
| 2009/0218027 | A1 | 9/2009 | Moe |
| 2009/0232594 | A1 | 9/2009 | Ng et al. |
| 2010/0041271 | A1 | 2/2010 | Van Swearingen et al. |
| 2010/0130060 | A1 | 5/2010 | Islam |
| 2010/0190377 | A1 | 7/2010 | Islam |
| 2010/0190378 | A1 | 7/2010 | Islam |
| 2010/0233903 | A1 | 9/2010 | Islam |
| 2010/0288819 | A1 | 11/2010 | Huenig et al. |
| 2012/0124827 | A1 | 5/2012 | Baldauf |
| 2012/0129375 | A1 | 5/2012 | Van Swearingen |
| 2012/0129383 | A1 | 5/2012 | Van Swearingen |
| 2012/0129388 | A1 | 5/2012 | Vaccaro et al. |
| 2012/0129389 | A1 | 5/2012 | Van Swearingen |
| 2012/0129390 | A1 | 5/2012 | Van Swearingen et al. |
| 2013/0025121 | A1 | 1/2013 | Van Swearingen et al. |
| 2013/0084738 | A1 | 4/2013 | Van Swearingen et al. |
| 2013/0084740 | A1 | 4/2013 | Paynter et al. |
| 2015/0229070 | A1 | 8/2015 | Van Swearingen |
| 2017/0133769 | A1 | 5/2017 | Harwath et al. |
| 2017/0170612 | A1 | 6/2017 | Van Swearingen et al. |
| 2017/0338613 | A1 | 11/2017 | Van Swearingen |

FOREIGN PATENT DOCUMENTS

| | | | |
|---|---|---|---|
| CN | 101055948 | | 10/2007 |
| CN | 201084845 | | 7/2008 |
| CN | 101494326 | | 7/2009 |
| CN | 102610973 | | 7/2012 |
| DE | 42 10 547 | C1 | 6/1993 |
| EP | 0779676 | | 6/1997 |
| EP | 1947661 | | 7/2008 |
| EP | 2214265 | | 8/2010 |
| EP | 2219267 | | 8/2010 |
| EP | 2219267 | A1 | 8/2010 |
| FR | 2164172 | | 7/1993 |
| GB | 2057781 | A | 4/1981 |
| GB | 2335804 | | 9/1999 |
| JP | 2002310117 | A | 10/2002 |
| WO | 94/13040 | | 6/1994 |
| WO | 2005/104301 | | 11/2005 |
| WO | 2009/052691 | | 4/2009 |

OTHER PUBLICATIONS

International Search Report and Written Opinion for related PCT Application No. PCT/US2011/046048, dated Feb. 9, 2012, 6 pages.
Azm A Parvez, USPTO Official Action for related U.S. Appl. No. 13/240,344; dated Aug. 29, 2013.
Sung Hee Kim, International Search Report for counterpart application PCT/US2011/046054, dated Feb. 29, 2012, Korean Intellectual Property Office, Seo-gu, Daejeon, Korea.
Examination Report Corresponding to European Application No. 13853093.6 dated Oct. 18, 2017.
Examination Report corresponding to European Application No. 11843870.4 dated Nov. 14, 2017.
Examination Report corresponding to Indian Patent Application No. 4591/DELNP/2013, dated Aug. 7, 2018.
Examination Report corresponding to Indian Patent Application No. 4592/DELNP/2013, dated Jul. 23, 2018.
Office Action corresponding to Indian Application No. 2354/DELNP/2014 dated Sep. 7, 2018.
Office Action corresponding to Indian Application No. 3912/CHENP/2013 dated Aug. 27, 2018.
Office Acton corresponding to Indian Application No. 4594/DELNP/2013 dated Sep. 27, 2018.
Examination Report Corresponding to European Patent Application No. 11843870.4 dated Nov. 28, 2018.
Office Action Corresponding to Indian Application No. 4590/DELNP/2013 dated Dec. 1, 2018.
Office Action corresponding to Indian Application No. 3975/CHENP/2013 dated Nov. 13, 2018.
Office Action corresponding to Indian Application No. 3530/DELNP/2015 dated Jan. 22, 2019.
Office Action corresponding to Indian Application No. 3861/DELNP/2015 dated Jan. 31, 2019.
Office Action Corresponding to Indian Application No. 2355/DELNP/2014 dated Jan. 23, 2019.
Office Action corresponding to Indian Application No. 3490/DENLP/2015 dated May 27, 2019.

* cited by examiner

METHOD AND APPARATUS FOR RADIAL ULTRASONIC WELDING INTERCONNECTED COAXIAL CONNECTOR

CROSS REFERENCE TO RELATED APPLICATIONS

This application is a continuation of and claims priority to U.S. Utility patent application Ser. No. 13/170,958, titled "Method and Apparatus for Radial Ultrasonic Welding Interconnected Coaxial Connector" filed Jun. 28, 2011 by Kendrick Van Swearingen, hereby incorporated by reference, which is a continuation-in-part of commonly owned co-pending U.S. Utility patent application Ser. No. 13/161,326, titled "Method for Ultrasonic Welding a Coaxial Cable to a Coaxial Connector" filed Jun. 15, 2011 by Kendrick Van Swearingen, hereby incorporated by reference, which is a continuation-in-part of commonly owned co-pending U.S. Utility patent application Ser. No. 12/980,013 titled "Method of Interconnecting a Coaxial Connector to a Coaxial Cable Via Ultrasonic Welding" filed Dec. 28, 2010 by Kendrick Van Swearingen, hereby incorporated by reference in its entirety. U.S. Utility patent application Ser. No. 13/170,958 is also a continuation-in-part of commonly owned co-pending U.S. Utility patent application Ser. No. 12/974,765 titled "Friction Weld Inner Conductor Cap and Interconnection Method" filed Dec. 21, 2010 by Kendrick Van Swearingen, hereby incorporated by reference in its entirety. U.S. Utility patent application Ser. Nos. 12/980,013 and 12/974,765 are each a continuation-in-part of commonly owned co-pending U.S. Utility patent application Ser. No. 12/951,558, titled "Laser Weld Coaxial Connector and Interconnection Method", filed Nov. 22, 2010 by Ronald A. Vaccaro, Kendrick Van Swearingen, James P. Fleming, James J. Wlos and Nahid Islam, hereby incorporated by reference in its entirety.

BACKGROUND

Field of the Invention

This invention relates to electrical cable connectors. More particularly, the invention relates to a coaxial connector and a method and apparatus for interconnection of such a coaxial cable connector with a coaxial cable, wherein a desired interconnection interface may be coupled via radial ultrasonic welding to a connector adapter previously coupled to a coaxial cable end.

Description of Related Art

Coaxial cable connectors are used, for example, communication systems requiring a high level of precision and reliability.

To create a secure mechanical and optimized electrical interconnection between the cable and the connector, it is desirable to have generally uniform, circumferential contact between a leading edge of the coaxial cable outer conductor and the connector body. A flared end of the outer conductor may be clamped against an annular wedge surface of the connector body via a coupling body. Representative of this technology is commonly owned U.S. Pat. No. 6,793,529 issued Sep. 21, 2004 to Buenz. Although this type of connector is typically removable/re-useable, manufacturing and installation is complicated by the multiple separate internal elements required, interconnecting threads and related environmental seals.

Connectors configured for permanent interconnection via solder and/or adhesive interconnection are also well known in the art. Representative of this technology is commonly owned U.S. Pat. No. 5,802,710 issued Sep. 8, 1998 to Bufanda et al. However, solder and/or adhesive interconnections may be difficult to apply with high levels of quality control, resulting in interconnections that may be less than satisfactory, for example when exposed to vibration and/or corrosion over time.

Passive Intermodulation Distortion, also referred to as PIM, is a form of electrical interference/signal transmission degradation that may occur with less than symmetrical interconnections and/or as electro-mechanical interconnections shift or degrade over time, for example due to mechanical stress, vibration, thermal cycling and/or material degradation. PIM is an important interconnection quality characteristic, as PIM from a single low quality interconnection may degrade the electrical performance of an entire RF system.

During interconnection procedures, the coaxial connector and/or coaxial cable may be mounted in a fixture which secures the connector and/or cable in a secure pre-determined orientation with respect to one another. Depending upon the type of interconnection, multiple fixtures and/or mounting/remounting may be required to perform separate portions of the interconnection procedure, such as separately forming secure electro-mechanical interconnections with respect to each of the inner and outer conductors of the coaxial cable. However, each mounting/remounting procedure consumes additional time and/or may provide opportunities for the introduction of alignment errors. Further, repeated mounting/remounting may wear and/or damage mating surfaces of the assembly.

Coaxial cables may be provided with connectors pre-attached. Such coaxial cables may be provided in custom or standardized lengths, for example for interconnections between equipment in close proximity to each other where the short cable portions are referred to as jumpers. To provide a coaxial cable with a high quality cable to connector interconnection may require either on-demand fabrication of the specified length of cable with the desired connection interface or stockpiling of an inventory of cables/jumpers in each length and interface that the consumer might be expected to request. On-demand fabrication and/or maintaining a large inventory of pre-assembled cable lengths, each with one of many possible connection interfaces, may increase delivery times and/or manufacturing/inventory costs.

Competition in the coaxial cable connector market has focused attention on improving electrical performance and long term reliability of the cable to connector interconnection. Further, reduction of delivery times and overall costs, including materials, training and installation costs, is a significant factor for commercial success.

Therefore, it is an object of the invention to provide a coaxial connector and method of interconnection that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
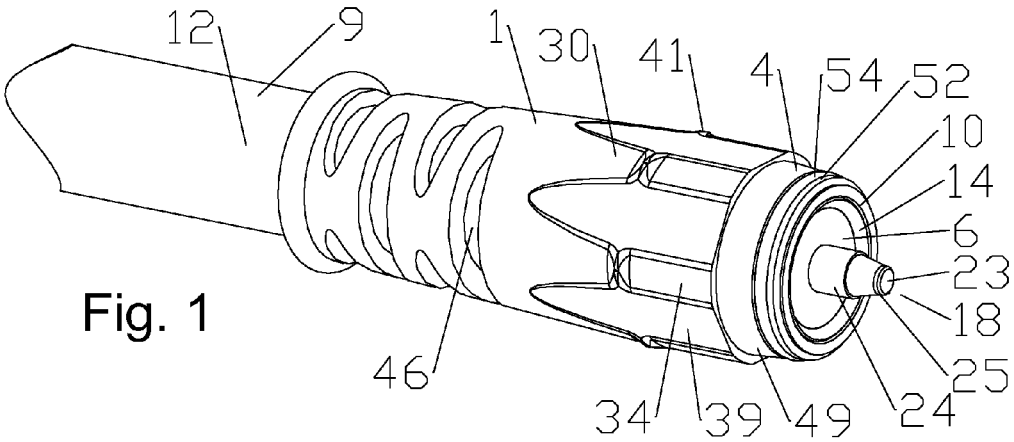
FIG. 1 is a schematic isometric view of an exemplary embodiment of a connector adapter coupled to a coaxial cable.
Figure 2:
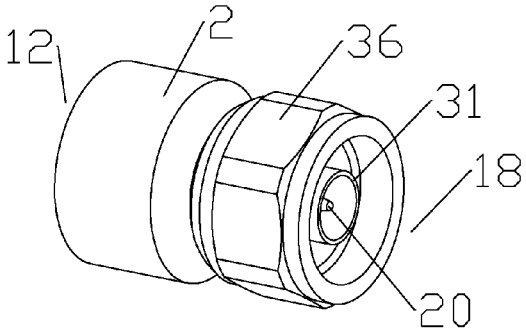
FIG. 2 is a schematic isometric view of an interface end, with a Type-N Male connector interface.
Figure 3:
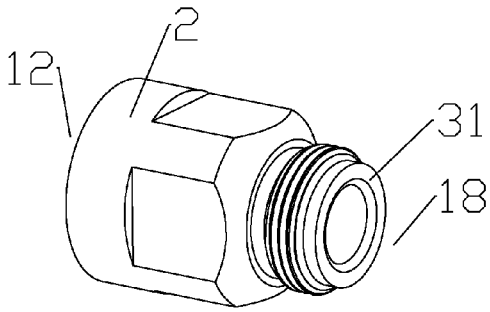
FIG. 3 is a schematic isometric view of an interface end, with a Type-N Female connector interface.

Aluminum has been applied as a cost-effective alternative to copper for the conductors in coaxial cables. However, aluminum oxide surface coatings quickly form upon air-exposed aluminum surfaces. These aluminum oxide surface coatings may degrade traditional mechanical, solder and/or conductive adhesive interconnections.

The inventor has recognized that increasing acceptance of coaxial cable with solid outer and/or inner conductors of aluminum and/or aluminum alloy enables connectors configured for interconnection via ultrasonic welding between the outer and inner conductors and a respective connector body and/or inner conductor cap inner contact which may each also be cost effectively provided, for example, formed from aluminum and/or aluminum alloy.

Further with respect to the inner conductor interconnection, the inventor has identified several difficulties arising from the interconnection of aluminum inner conductor coaxial cable configurations with prior coaxial cable connectors having inner contact configurations. Prior coaxial connector mechanical interconnection inner contact configurations are generally incompatible with aluminum inner conductors due to the creep characteristics of aluminum. Further, galvanic corrosion between the aluminum inner conductor and a dissimilar metal of the inner contact, such as bronze, brass or copper, may contribute to accelerated degradation of the electro-mechanical interconnection.

Utilizing friction welding, such as ultrasonic welding, for both the outer conductor to connector body and inner conductor to inner conductor cap interconnections enables a molecular bond interconnection with inherent resistance to corrosion and/or material creep interconnection degradation. Further, a molecular bond interconnection essentially eliminates the opportunity for PIM generation due to shifting and/or degrading mechanical interconnections.

An ultrasonic weld may be formed by applying ultrasonic vibrations under pressure in a join zone between two parts desired to be welded together, resulting in local heat sufficient to plasticize adjacent surfaces that are then held in contact with one another until the interflowed surfaces cool, completing the weld. An ultrasonic weld may be applied with high precision via a sonotrode and/or simultaneous sonotrode ends to a point and/or extended surface. Where a point ultrasonic weld is applied, successive overlapping point welds may be applied to generate a continuous ultrasonic weld.

Because the localized abrasion of the ultrasonic welding process can break up any aluminum oxide surface coatings in the immediate weld area, no additional treatment may be required with respect to removing or otherwise managing the presence of aluminum oxide on the interconnection surfaces.

Ultrasonic vibrations may be applied, for example, in a linear direction and/or reciprocating along an arc segment, known as torsional vibration. For the interconnection of a coaxial connector and coaxial cable, these types of ultrasonic welding have previously typically utilized application of the sonotrode proximate the join zone from a direction in parallel with the longitudinal axis of the coaxial cable. Thus, the join zone location must be proximate the end of the assembly.

The inventor has further recognized that interconnecting welds may be performed via ultrasonic vibrations applied to the cable and connector by a sonotrode approaching the join zone from a radial direction. Herein, a radial direction is a direction that is generally normal to the longitudinal axis of the coaxial cable. Therefore, radial ultrasonic welding is ultrasonic welding in which the weld is formed radially inward from an outer diameter of one of the elements being welded together, by a sonotrode applied to the outer diameter.

By performing radial ultrasonic welding upon the interconnection, an ultrasonic weld may be performed wherein the join zone is not proximate the end of the resulting assembly. Thereby, ultrasonic welded interconnections spaced away from the assembly end, such as between a connector adapter and a desired connection interface, are enabled.

Figure 4:
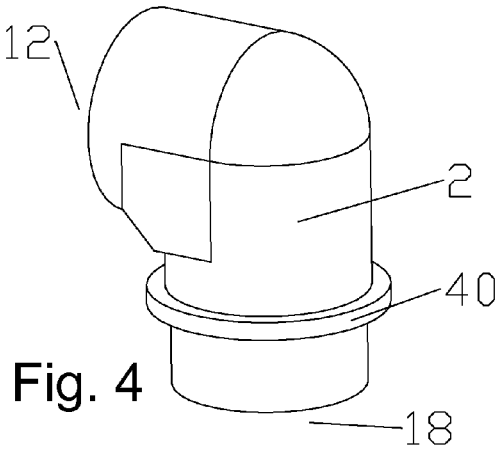
FIG. 4 is a schematic isometric view of an interface end with a 7/16 DIN-Male connector interface.
Figure 5:
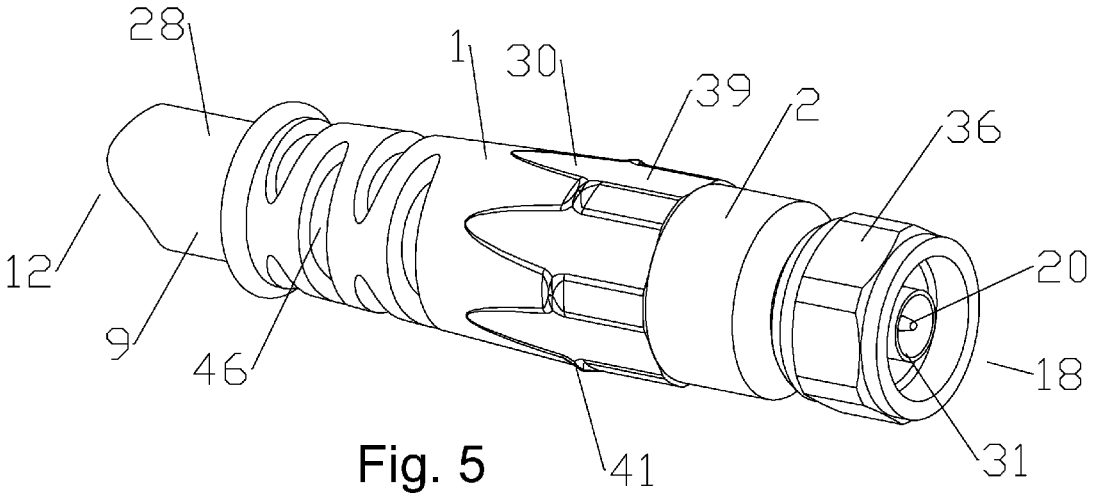
FIG. 5 is a schematic isometric view of the connector adapter of FIG. 1 with the interface end of FIG. 2 mounted thereon.
Figure 6:
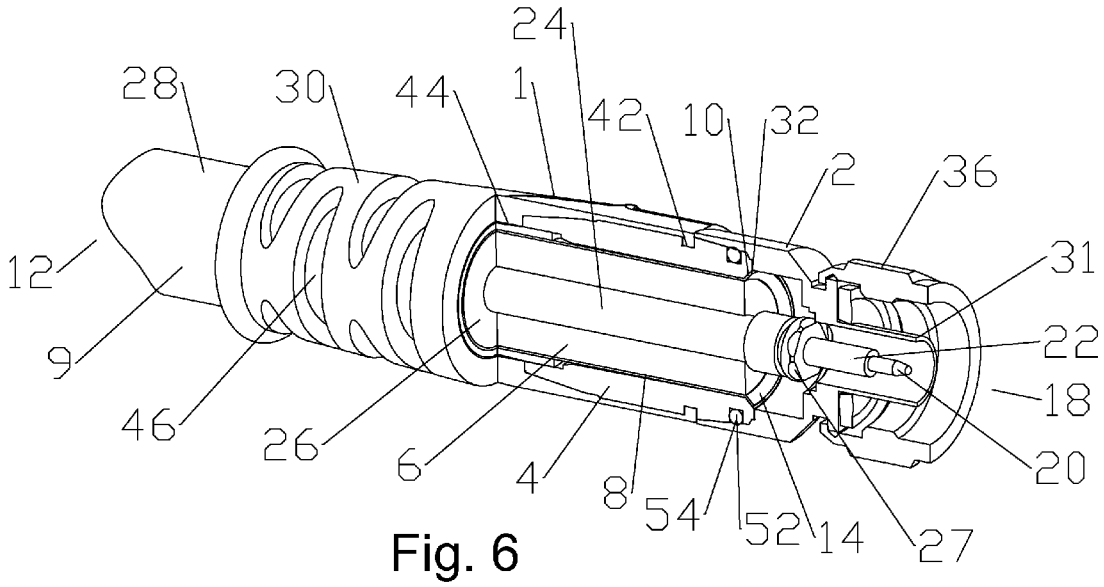
FIG. 6 is a schematic isometric partial cut-away view of FIG. 5.
Figure 7:
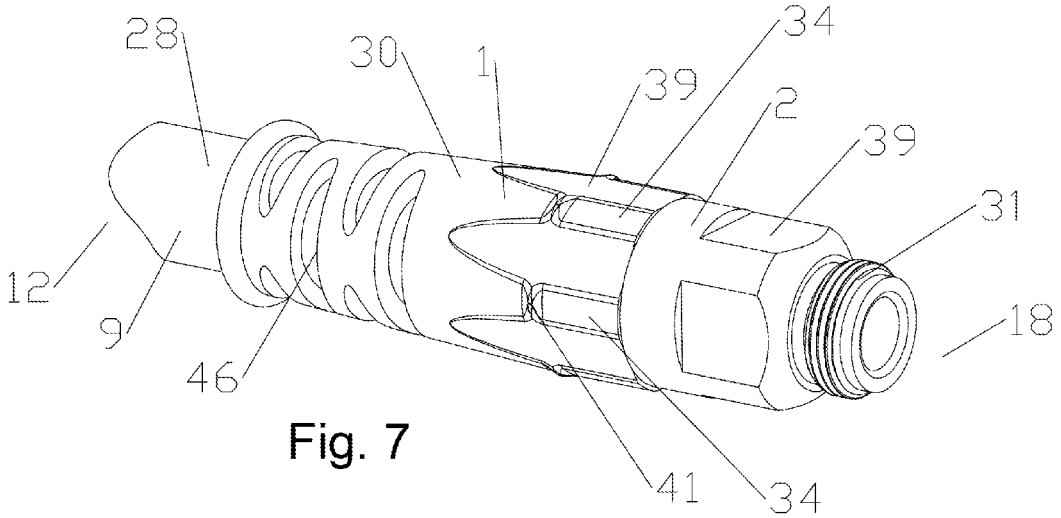
FIG. 7 is a schematic isometric view of the connector adapter of FIG. 1 with the interface end of FIG. 3 mounted thereon.
Figure 8:
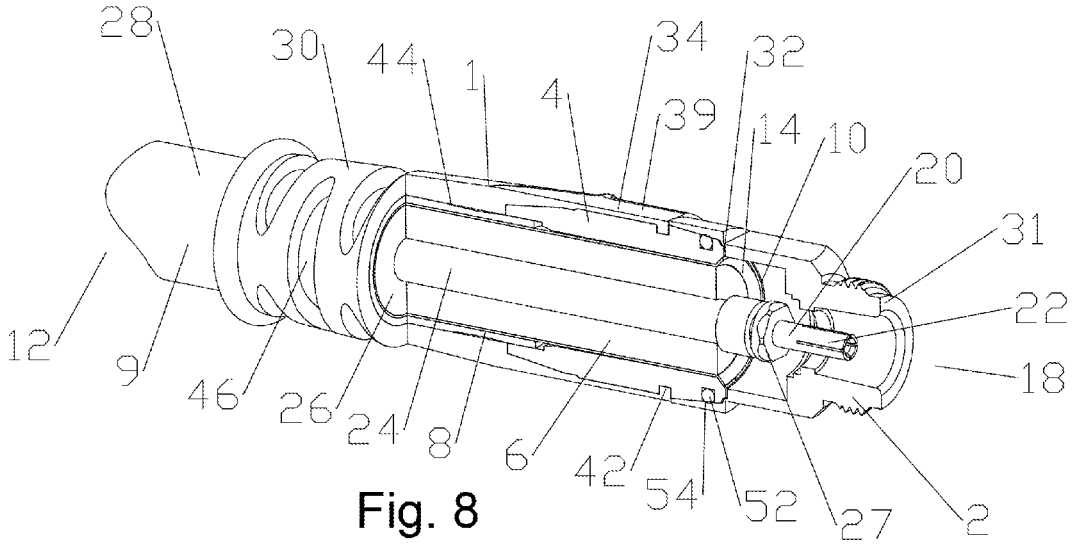
FIG. 8 is a schematic isometric partial cut-away view of FIG. 7.

Exemplary embodiments of a connector adapter 1 and various interface ends 2 interconnectable via radial ultrasonic welding are demonstrated in FIGS. 1-10. As best shown in FIGS. 5 and 6, the connector adapter comprises a unitary connector body 4 provided with a bore 6 dimensioned to receive the outer conductor 8 of a coaxial cable 9 therein.

The connector adapter 1 may be interconnected with the outer conductor 8 according to conventional methods which preferably result in a molecular bond between the connector body 4 and the outer conductor 8. The present embodiment demonstrates an ultrasonic welded interconnection between the connector body 4 and the outer conductor 8. As best shown in FIG. 1, a flare seat 10 angled radially outward from the bore 6 toward a connector end 18 of the connector body 4 is open to the connector end of the connector adapter 1, thereby providing a mating surface to which a leading end flare 14 of the outer conductor 8 may be ultrasonically welded by an outer conductor sonotrode of an ultrasonic welder inserted to contact the leading end flare 14 from the connector end 18.

One skilled in the art will appreciate that connector end 18 and cable end 12 are applied herein as identifiers for respective ends of both the coaxial connector 2 and also of discrete elements of the coaxial connector 2 and sonotrodes described herein, to identify same and their respective interconnecting surfaces according to their alignment along a longitudinal axis of the connector between a connector end 18 and a cable end 12.

Prior to interconnection via ultrasonic welding, the leading end of the coaxial cable 9 may be prepared by cutting the coaxial cable 9 so that the inner conductor 24 extends from the outer conductor 8. Also, dielectric material 26 between the inner conductor 24 and outer conductor 8 may be stripped back and a length of the outer jacket 28 removed to expose desired lengths of each.

The cable end 12 of the coaxial cable 9 is inserted through the bore 6 and an annular flare operation is performed on a leading edge of the outer conductor 8. The resulting leading end flare 14 may be angled to correspond to the angle of the flare seat 10 with respect to a longitudinal axis of the coaxial connector 2. By performing the flare operation against the flare seat 10, the resulting leading end flare 14 can be formed with a direct correspondence to the flare seat angle. The flare operation may be performed utilizing the leading edge of the outer conductor sonotrode, provided with a conical cylindrical inner lip with a connector end 18 diameter less than an inner diameter of the outer conductor 8, for initially engaging and flaring the leading edge of the outer conductor 8 against the flare seat 10.

An overbody 30, as shown for example in FIG. 1, may be applied to the connector body 4 as an overmolding of polymeric material. The overbody 30 increases cable to connector torsion and pull resistance.

The overbody 30 may be provided dimensioned with an outer diameter cylindrical support surface 34. Tool flats 39 (see FIG. 1) for retaining the resulting coaxial connector during interconnection with other cables and/or devices may be formed in the cylindrical support surface 34 by removing surface sections of the cylindrical support surface 34. Alternatively and/or additionally, tool flats 39 may be formed on the interface end 2 (see FIG. 7).

Figure 9:
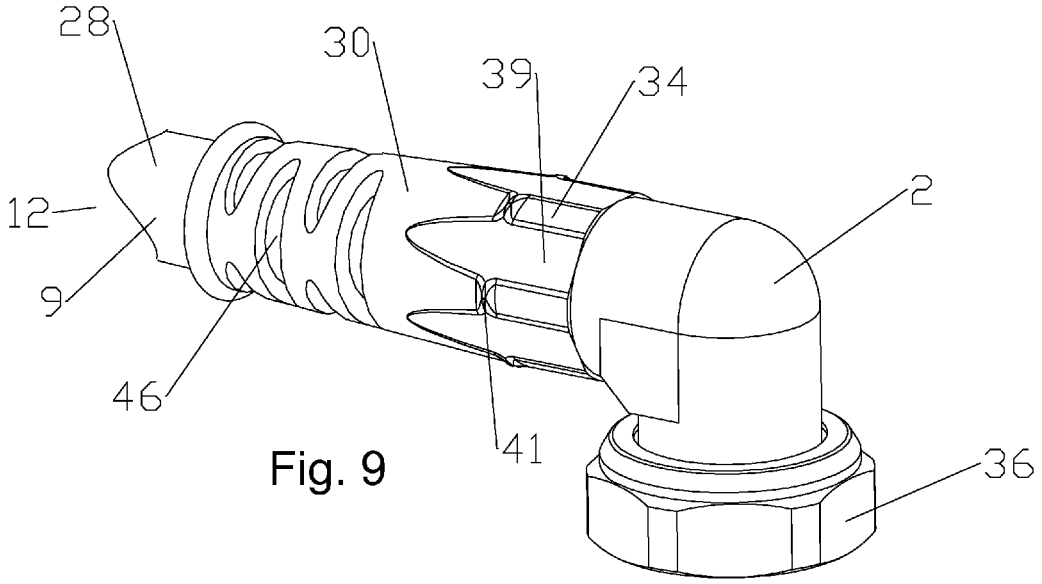
FIG. 9 is a schematic isometric view of the connector adapter of FIG. 1 with the interface end of FIG. 4 and a coupling nut mounted thereon.
Figure 10:
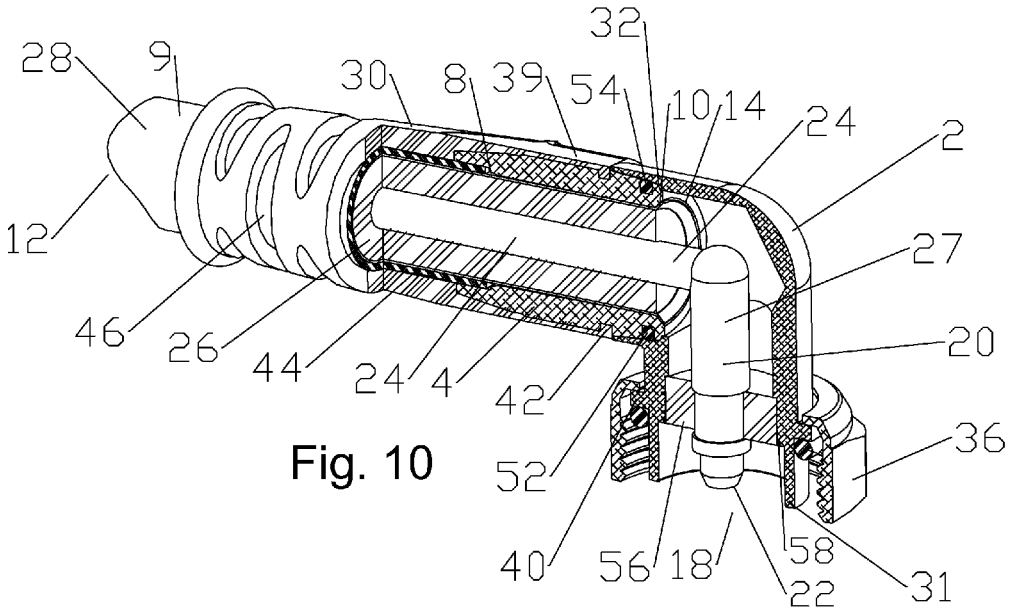
FIG. 10 is a schematic isometric partial cut-away view of FIG. 9.

Depending on the selected interface end 2 and connection interface 31 thereupon, a coupling nut 36 may be present upon the interface end 2 retained at the connector end 18 by a flange 40 of the interface end 2 (see FIGS. 4, 9 and 10). The coupling nut 36 may be retained upon the cylindrical support surface 34 and/or support ridges of the overbody 30 by applying one or more retention spurs 41 (see FIG. 1) proximate the cable end of the cylindrical support surface 34. The retention spurs 41 may be angled with increasing diameter from the cable end 12 to the connector end 18, allowing the coupling nut 36 to be passed over them from the cable end 12 to the connector end 18, but then retained upon the cylindrical support surface 34 by a stop face provided at the connector end 18 of the retention spurs 41.

The overbody 30 may be securely keyed to the connector body 4 via one or more interlock apertures 42 such as holes, longitudinal knurls, grooves, notches or the like provided in the outer diameter of the connector body 4, as shown for example in FIG. 6. Thereby, as the polymeric material of the overbody 30 flows into the one or more interlock apertures 42 during overmolding, upon curing the overbody 30 is permanently coupled to and rotationally interlocked with the connector body 4.

The cable end of the overbody 30 may be dimensioned with an inner diameter friction surface 44 proximate that of the coaxial cable jacket 28, enabling, for example, an interference fit and/or polymeric friction welding between the overbody 30 and the jacket 28, by rotation of the connector body 4 with respect to the outer conductor 8, thereby eliminating the need for environmental seals at the cable end 12 of the connector/cable interconnection.

As best shown in FIG. 1, the overbody 30 may also have an extended cable portion proximate the cable end provided with a plurality of stress relief apertures 46. The stress relief apertures 46 may be formed in a generally elliptical configuration with a major axis of the stress relief apertures 46 arranged normal to the longitudinal axis of the coaxial connector 2. The stress relief apertures 46 enable a flexible characteristic of the cable end of the overbody 30 that increases towards the cable end of the overbody 30. Thereby, the overbody 30 supports the interconnection between the coaxial cable 9 and the coaxial connector 2 without introducing a rigid end edge along which a connected coaxial cable 2 subjected to bending forces may otherwise buckle, which may increase both the overall strength and the flexibility characteristics of the interconnection.

Where the overbody 30 is interconnected with the jacket 28 via friction welding, friction between the friction surface 44 and the outer diameter of the jacket 28 heats the respective surfaces to a point where they begin to soften and intermingle, sealing them against one another. The jacket 28 and and/or the inner diameter of the overbody 30 may be provided as a series of spaced apart annular peaks of a contour pattern such as a corrugation, or a stepped surface, to provide enhanced friction, allow voids for excess friction weld material flow, and/or add key locking for additional strength. Alternatively, the overbody 30 may be sealed against the outer jacket 28 with an adhesive/sealant or may be overmolded upon the connector body 4 after interconnection with the outer conductor 8, the heat of the injected polymeric material bonding the overbody 30 with and/or sealing against the jacket 28.

Figure 11:
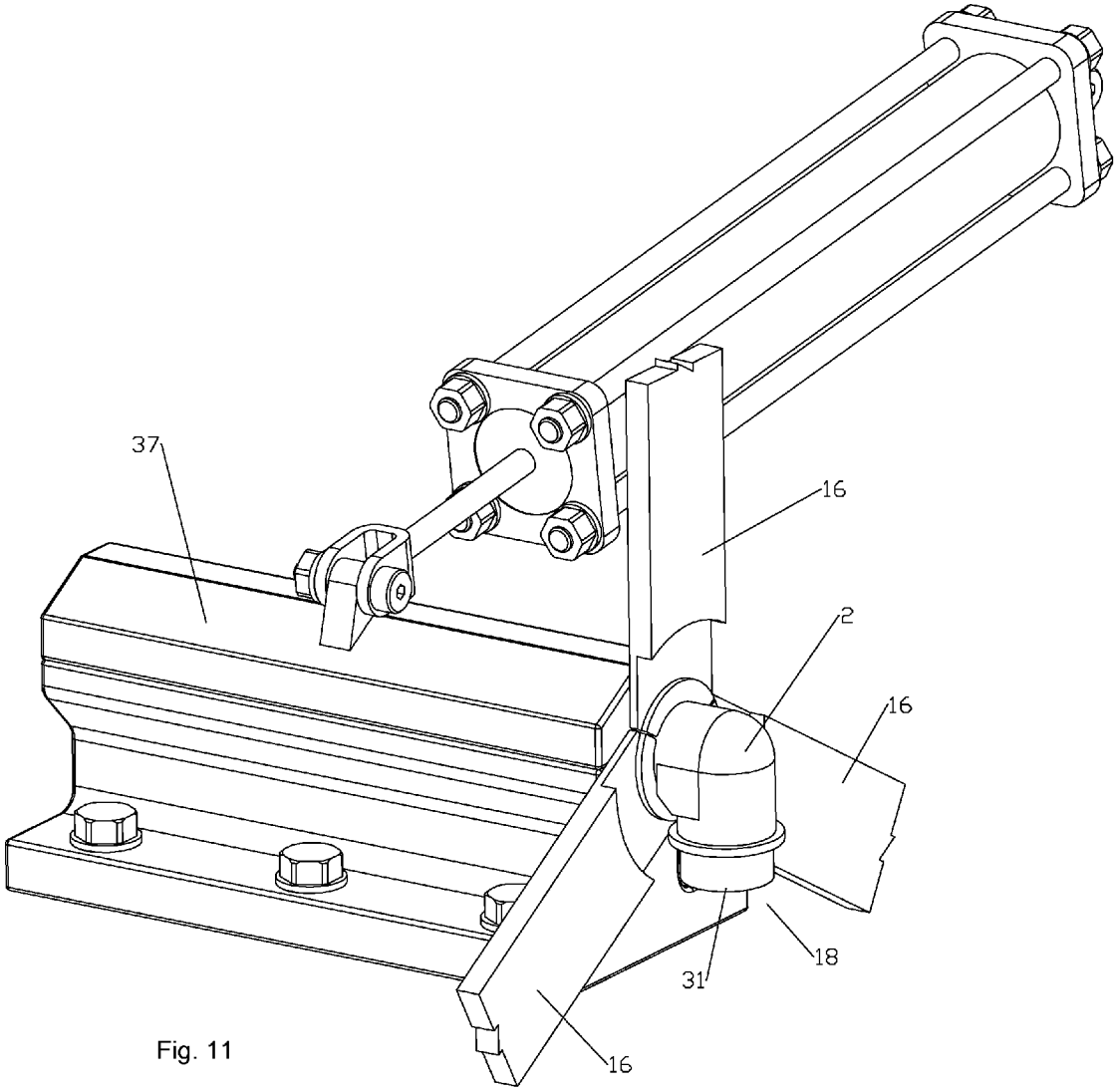
FIG. 11 is a schematic isometric view of a fixture in a closed position for retaining the coaxial cable, connector adapter and interface end for interconnection via radial ultrasonic welding.

In a method for ultrasonic cable and connector adapter interconnection, the prepared end of the coaxial cable 9 is inserted through the coupling nut 36, if present, (the coupling nut 36 is advanced along the coaxial cable 9 out of the way until interconnection is completed) and connector body bore 6 so that the outer conductor 8 extends past the flare seat 10 a desired distance. The connector body 4 and/or cable end of the overbody 30 may be coated with an adhesive prior to insertion, and/or a spin welding operation may be performed to fuse the overbody 30 and/or cable end of the connector body 4 with the jacket 28. The connector body 4 and coaxial cable 9 are then retained in a fixture 37, rigidly securing these elements for the flaring and electrical interconnection friction welding via ultrasonic welding steps. One skilled in the art will appreciate that the fixture 37 may be any manner of releasable retention mechanism into which the coaxial cable and/or coaxial connector 2 may be easily inserted and then released, for example as demonstrated in FIG. 11.

The flaring operation may be performed with a separate flare tool or via advancing the outer conductor sonotrode to contact the leading edge of the head of the outer conductor 8, resulting in flaring the leading edge of the outer conductor 8 against the flare seat 10. Once flared, the outer conductor sonotrode may be advanced (if not already so seated after flaring is completed) upon the leading end flare 14 and ultrasonic welding initiated.

Ultrasonic welding may be performed, for example, utilizing linear and/or torsional vibration. In linear vibration ultrasonic-type friction welding of the leading end flare 14 to the flare seat 10, a linear vibration is applied to a cable end side of the leading end flare 14, while the coaxial connector 2 and flare seat 10 therewithin are held static within the fixture 37. The linear vibration generates a friction heat which plasticizes the contact surfaces between the leading end flare 14 and the flare seat 10. Where linear vibration ultrasonic-type friction welding is utilized, a suitable frequency and linear displacement, such as between 20 and 40 KHz and 20-35 microns, selected for example with respect to a material characteristic, diameter and/or sidewall thickness of the outer conductor 8, may be applied.

A desired interface end 2 may be applied to the connector adapter 1 immediately upon completion of the connector adapter and coaxial cable interconnection, or at a later time according to a just-in-time custom order fulfillment procedure.

Where the inner conductor 24 is also aluminum material some applications may require a non-aluminum material connection point at the inner contact/inner conductor of the connection interface 31. As shown for example in FIGS. 6, 8 and 10 an inner conductor cap 20, for example formed from a metal such as brass or other desired metal, may be applied to the end of the inner conductor 24, also by friction welding such as ultrasonic welding.

The inner conductor cap 20 may be provided with an inner conductor socket at the cable end 12 and a desired inner conductor interface 22 at the connector end 4. The inner conductor socket may be dimensioned to mate with a prepared end 23 of an inner conductor 24 of a coaxial cable 9. To apply the inner conductor cap 20, the end of the inner conductor 24 is ground to provide a pin corresponding to the selected socket geometry of the inner conductor cap 20. To allow material inter-flow during welding attachment, the socket geometry of the inner conductor cap 20 and/or the end of the inner conductor 24 may be formed to provide a material gap 25.

A rotation key 27 may be provided upon the inner conductor cap 20, the rotation key 27 dimensioned to mate with an inner sonotrode tool for rotating and/or torsionally reciprocating the inner conductor cap 20, for interconnection via ultrasonic friction welding.

In torsional vibration ultrasonic-type friction welding, a torsional vibration is applied to the interconnection via the inner conductor sonotrode coupled to the inner conductor cap 20 by the rotation key 27, while the coaxial cable 9 with inner conductor 24 therewithin are held static within the fixture 37. The torsional vibration generates a friction heat which plasticizes the contact surfaces between the prepared end 23 and the inner conductor cap 20. Where torsional vibration ultrasonic-type friction welding is utilized, a suitable frequency and torsional vibration displacement, for example between 20 and 40 KHz and 20-35 microns, may be applied, also selected with respect to material characteristics and/or dimensions of the mating surfaces.

With the desired inner conductor cap 20 coupled to the inner conductor 24, the corresponding interface end 2 may be seated upon the mating surface 49 and ultrasonic welded. The mating surface 49 has a diameter which decreases towards the connector end 18, such as a conical or a curved surface, enabling a self-aligning fit that may be progressively tightened by application of axial compression.

As best shown in FIG. 1, the selected interface end 2 seats upon a mating surface 49 provided on the connector end 18 of the connector adapter 1. The interface end 2 may be seated upon the mating surface 49, for example in a self aligning interference fit, until the connector end of the connector adapter 1 abuts a stop shoulder 32 of the interface end bore and/or cable end of the connector adapter 1 abuts the connector end of the overbody 30 (See FIG. 5).

An annular seal groove 52 may be provided in the mating surface for a gasket 54 such as a polymer o-ring for environmentally sealing the interconnection of the connector adapter 1 and the selected interface end 2.

Figure 12:
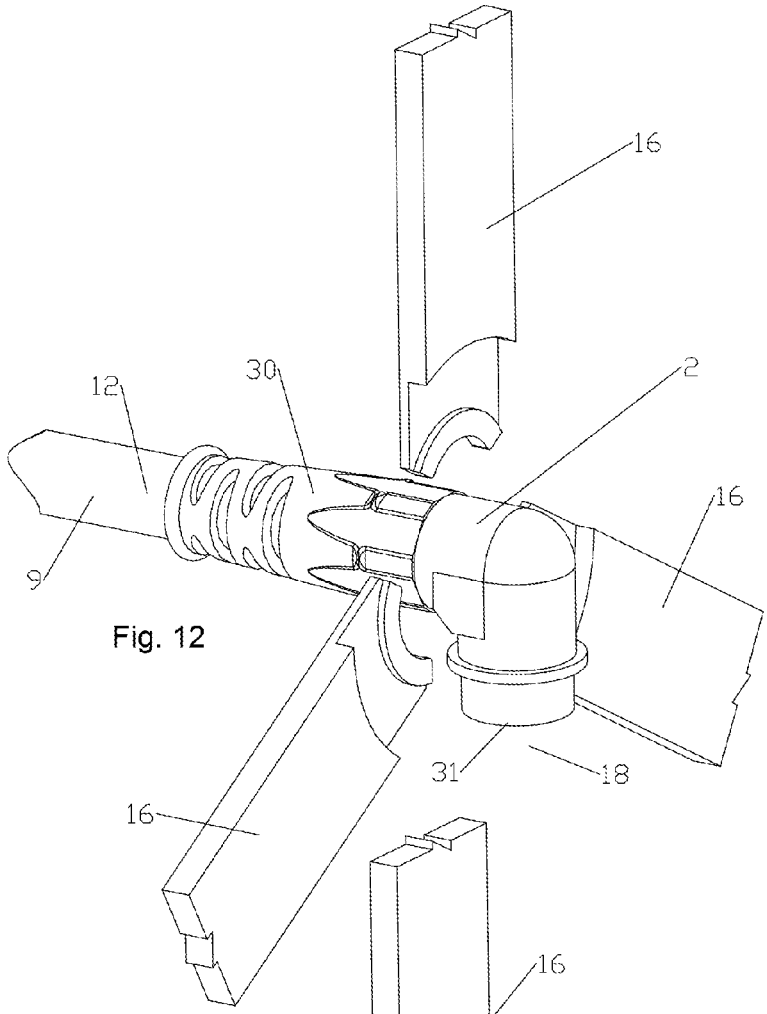
FIG. 12 is a schematic isometric view of the connector adapter of FIG. 1, immediately prior to simultaneous sonotrode engagement for radial ultrasonic welding of the interface end to the mating surface.
Figure 13:
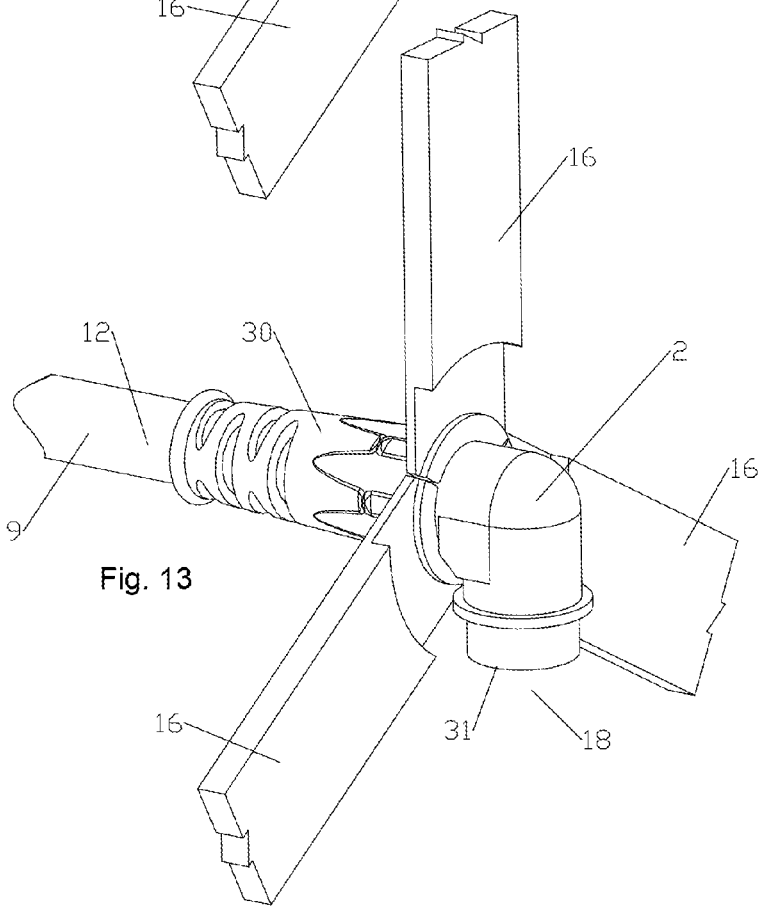
FIG. 13 is a schematic isometric view of FIG. 12, with the sonotrodes engaging the outer diameter of the interface end for radial ultrasonic welding.
Figure 14:
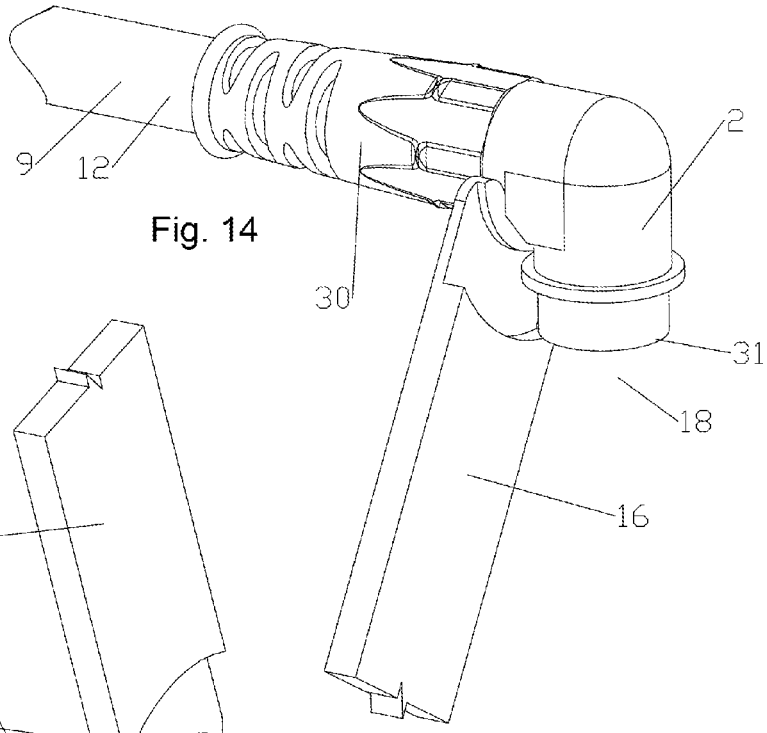
FIG. 14 is a schematic isometric view of a single sonotrode engaging an arc segment of the outer diameter of the interface end for radial ultrasonic welding.
Figure 15:
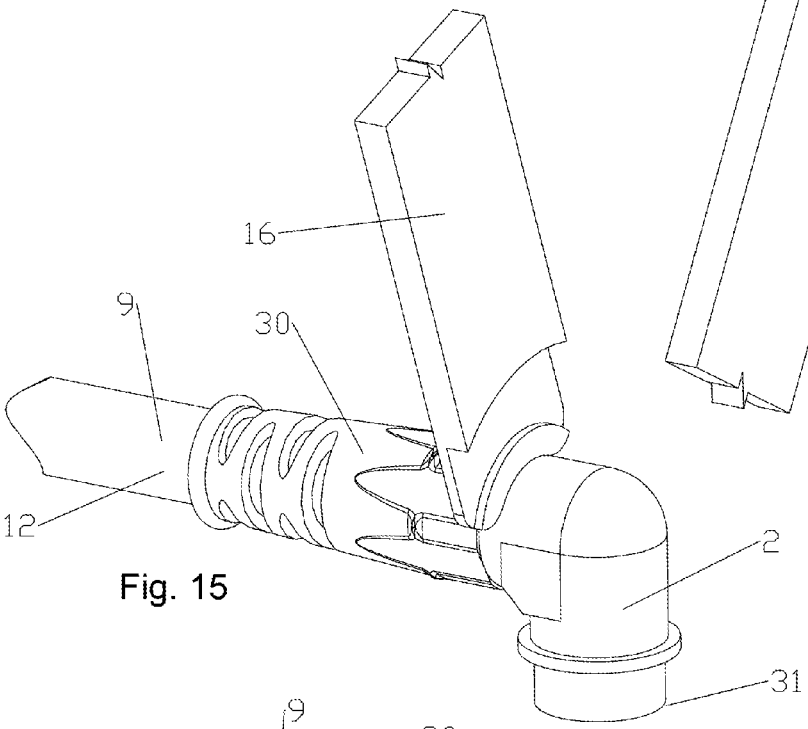
FIG. 15 is a schematic isometric view of another single sonotrode engaging another arc segment of the outer diameter of the interface end for radial ultrasonic welding.
Figure 16:
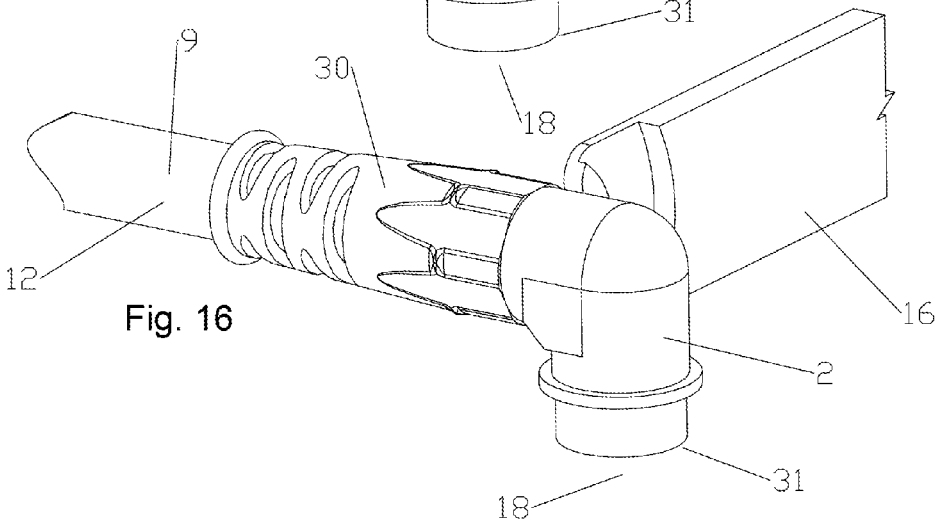
FIG. 16 is a schematic isometric view of another single sonotrode engaging a final arc segment of the outer diameter of the interface end for radial ultrasonic welding.

As the mating surfaces between the connector adapter 1 and the connector end 2 are located spaced away from the connector end 18 of the resulting assembly, radial ultrasonic welding is applied As best shown in FIGS. 12 and 13, a plurality of sonotrodes 16 may be extended radially inward toward the outer diameter of the cable end of the interface end 2 to apply the selected ultrasonic vibration to the joint area. Alternatively, as shown for example in FIGS. 14-16, a single sonotrode 16 may be applied moving to address each of several designated arc portions of the outer diameter of the joint area or upon overlapping arc portions of the outer diameter of the joint area in sequential welding steps or in a continuous circumferential path along the join zone. Where the seal groove 52 and gasket 54 are present, even if a contiguous circumferential weld is not achieved, the interconnection remains environmentally sealed.

One skilled in the art will appreciate that the interface end 2 may also be in the form of a right angle connector configuration, for example as shown in FIGS. 4, 9 and 10. In this configuration, the extent of the inner conductor cap 20 extending normal to the inner conductor 24 may be utilized as the rotation key 27. Additional support of the extended inner conductor cap 20 may be provided by application of an inner conductor cap insulator 56, after the interface end 2 is seated upon the connector adapter 1. The inner conductor cap insulator 56 may snap-fit into place and/or be retained by a stamping operation upon a deformation groove 58 provided in the connection interface 31 of the connector end 2.

Although the interconnection between the connector adapter 1 and the outer conductor 8 has been demonstrated as performed by ultrasonic welding, one skilled in the art will appreciate that in alternative embodiments this interconnection may be achieved via other methods. Preferably, the interconnection results in a molecular bond interconnection. A molecular bond interconnection may also be achieved for example via laser welding or spin welding.

Figure 17:
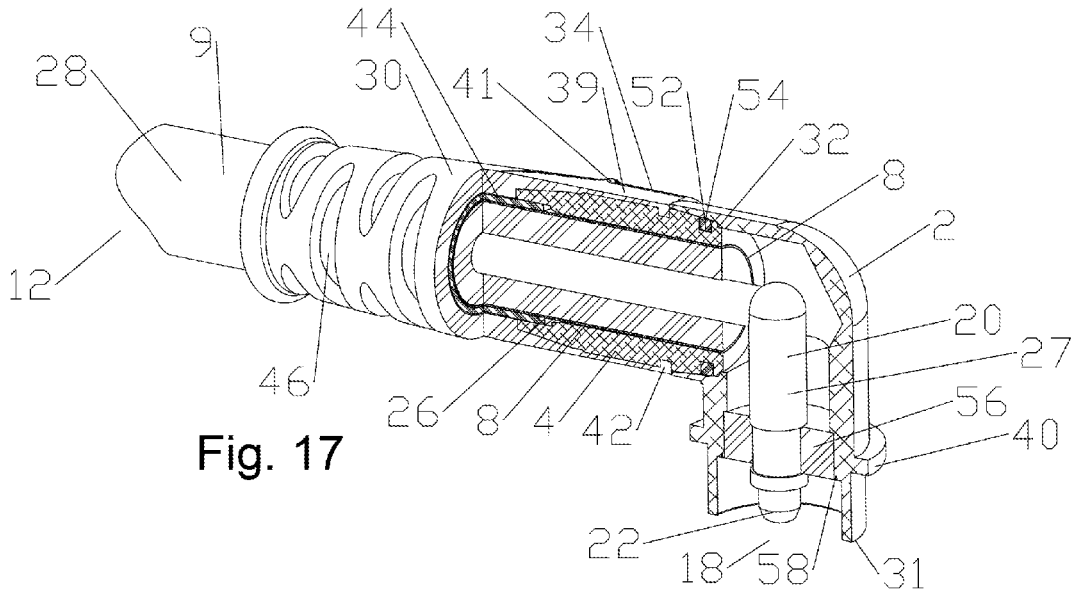
FIG. 17 is an alternative embodiment of a connector adapter adapted for coupling with the outer conductor of the coaxial cable via laser welding.

As shown for example in FIG. 17, in a laser weld embodiment, the flare seat is omitted and a laser weld is applied to the joint between the outer conductor 8 and the connector body 4 at the connector end of the bore 6.

Figure 18:
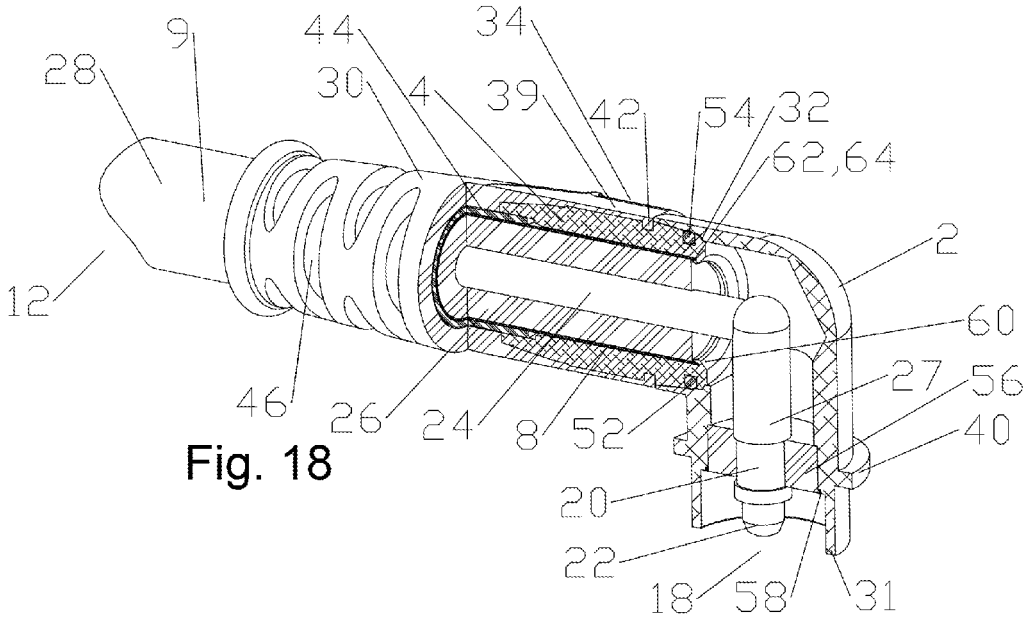
FIG. 18 is an alternative embodiment of a connector adapter adapted for coupling with the outer conductor of the coaxial cable via spin welding.

As shown for example in FIG. 18, in a spin weld embodiment, instead of the flare seat, an inward projecting shoulder 60 angled toward a cable end 12 of the connector body 4 forms an annular friction groove 62 open to the cable end 12.

The friction groove 62 is dimensioned to receive a leading edge of the outer conductor 8 therein, a thickness of the outer conductor 8 preventing the outer conductor 8 from initially bottoming in the friction groove 62, forming an annular material chamber 64 between the leading edge of the outer conductor 8 and the bottom of the friction groove 62, when the outer conductor 8 is initially seated within the friction groove 14. Friction generated by rotation of the connector adapter 1 with respect to the outer conductor 8 generates sufficient heat to soften the leading edge and/or localized adjacent portions of the outer conductor 8 and connector body 4, forging them together as the sacrificial portion of the outer conductor 8 forms a plastic weld bead that flows into the material chamber 64 to fuse the outer conductor 8 and connector body 4 together.

One skilled in the art will appreciate that the connector adapter 1 and interconnection method disclosed has significant material cost efficiencies and provides a permanently sealed interconnection with reduced size and/or weight requirements. Finally, because a circumferential molecular bond is established at the connector body 4 to outer conductor 8 electromechanical interconnection, PIM resulting from such interconnection may be significantly reduced and/or entirely eliminated.

The coaxial cable 9, connector adapter 1 and interface end 2 provide a high quality assembly with advantageous characteristics. The assembly may be quickly and cost efficiently configured according to a specific customer connection interface 31 requirements, without maintaining an extensive finished jumper inventory. By pre-applying connector adapter 1 to the coaxial cables, potential for damage to the cable ends during storage and/or transport may be reduced and quality control of the interconnection may be improved. Further, high quality right angle connector interfaces are enabled, provided with reduced potential for PIM, again due to the molecular bond interconnection.

Table of Parts

| | |
|---|---|
| 1 | connector adapter |
| 2 | interface end |
| 4 | connector body |
| 6 | bore |
| 8 | outer conductor |
| 9 | coaxial cable |
| 10 | flare seat |
| 12 | cable end |
| 14 | leading end flare |
| 16 | sonotrode |
| 18 | connector end |
| 20 | inner conductor cap |
| 22 | inner conductor interface |
| 23 | prepared end |
| 24 | inner conductor |
| 25 | material gap |
| 26 | dielectric material |
| 27 | rotation key |
| 28 | jacket |
| 30 | overbody |
| 31 | connection interface |
| 32 | stop shoulder |
| 34 | support surface |
| 36 | coupling nut |
| 37 | fixture |
| 38 | alignment cylinder |
| 39 | tool flat |
| 40 | flange |
| 41 | retention spur |
| 42 | interlock aperture |
| 44 | friction surface |
| 46 | stress relief aperture |
| 49 | mating surface |

-continued

Table of Parts

| | |
|---|---|
| 52 | seal groove |
| 54 | gasket |
| 56 | insulator |
| 58 | deformation groove |
| 60 | inward projecting shoulder |
| 62 | friction groove |
| 64 | material chamber |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A coaxial cable-connector assembly, comprising:

(a) a coaxial cable comprising:

an inner conductor;

an outer conductor circumferentially surrounding the inner conductor; and a dielectric layer interposed between the inner conductor and the outer conductor; and (b) a coaxial connector, comprising:

an inner contact electrically connected with the inner conductor of the coaxial cable;

an intermediate body positioned radially outwardly of the inner contact, the intermediate body electrically connected to the outer conductor of the coaxial cable via a circumferential molecular bond; and an outer connector interface, electrically connected to the intermediate body, the outer connector interface configured to mate with an outer connector interface of a mating connector.

2. The assembly defined in claim 1, wherein the intermediate body has an internal bore, and wherein the molecular bond between the outer conductor of the coaxial cable and the intermediate body occurs in the internal bore.

3. The assembly defined in claim 1, wherein the outer connector interface circumferentially overlies at least a portion of the intermediate body.

4. The assembly defined in claim 1, wherein the outer connector interface is connected with the intermediate hotly via an interference fit.

5. The assembly defined in claim 1, further comprising an overbody that circumferentially overlies the intermediate body.

6. The assembly defined in claim 1, wherein the outer connector interface is configured to define a right angle connector.

7. The assembly defined in claim 1, wherein the outer conductor of the coaxial cable has a smooth profile.

8. A coaxial cable-connector assembly, comprising:
(a) a coaxial cable comprising:
an inner conductor;
an outer conductor circumferentially surrounding the inner conductor; and
a dielectric layer interposed between the inner conductor and the outer conductor; and
(b) a coaxial connector, comprising:
an inner contact electrically connected with the inner conductor of the coaxial cable;
an intermediate body positioned radially outwardly of the inner contact, the intermediate body electrically connected to the outer conductor of the coaxial cable via a laser weld; and
an outer connector interface electrically connected to the intermediate body, the outer connector interface configured to mate with an outer connector interface of a mating connector.

9. The assembly defined in claim 8, wherein the intermediate body has an internal bore, and wherein the laser weld between the outer conductor of the coaxial cable and the intermediate body occurs in the internal bore.

10. The assembly defined in claim 8, wherein the outer connector interface circumferentially overlies at least a portion of the intermediate body.

11. The assembly defined in claim 8, wherein the outer connector interface is connected with the intermediate body via an interference fit.

12. The assembly defined in claim 8, further comprising an overbody that circumferentially overlies the intermediate body.

13. The assembly defined in claim 8, wherein the outer connector interface is configured to define a right angle connector.

14. The assembly defined in claim 8, wherein the outer conductor of the coaxial cable has a smooth profile.

15. A coaxial cable-connector assembly, comprising:
(a) a coaxial cable comprising:
an inner conductor;
an outer conductor circumferentially surrounding the inner conductor; and
a dielectric layer interposed between the inner conductor and the outer conductor; and
(b) a coaxial connector, comprising:
an inner contact electrically connected with the inner conductor of the coaxial cable;
an intermediate body positioned radially outwardly of the inner contact, the intermediate body electrically connected to the outer conductor of the coaxial cable via a circumferential molecular bond; and
an outer connector interface electrically connected to the intermediate body, the outer connector interface configured to mate with an outer connector interface of a mating connector;
wherein the intermediate body has an internal bore, and wherein the molecular bond between the outer conductor of the coaxial cable and the intermediate body occurs in the internal bore; and
wherein the outer connector interface circumferentially overlies at least a portion of the intermediate body.

16. The assembly defined in claim 15, wherein the outer connector interface is connected with the intermediate body via an interference fit.

17. The assembly defined in claim 15, further comprising an overbody that circumferentially overlies the intermediate body.

18. The assembly defined in claim 15, wherein the outer connector interface is configured to define a right angle connector.

19. The assembly defined in claim 15, wherein the outer conductor of the coaxial cable has a smooth profile.

20. A coaxial cable-connector assembly, comprising:
(a) a coaxial cable comprising:
an inner conductor;
an outer conductor circumferentially surrounding the inner conductor; and
a dielectric, layer interposed between the inner conductor and the outer conductor; and
(b) a coaxial connector, comprising:
an inner contact electrically connected with the inner conductor of the coaxial cable;
an intermediate body positioned radially outwardly of the inner contact, the intermediate body electrically connected to the outer conductor of the coaxial cable via a circumferential laser weld; and
an outer connector interface electrically connected to the intermediate body, the outer connector interface configured to mate with an outer connector interface of a mating connector.

21. The assembly defined in claim 20, wherein the intermediate body has an internal bore, and wherein the laser weld between the outer conductor of the coaxial cable and the intermediate body occurs in the internal bore.

* * * * *